US006851130B2

(12) United States Patent
Berring

(10) Patent No.: US 6,851,130 B2
(45) Date of Patent: Feb. 8, 2005

(54) SANITARY TOILET SEAT APPARATUS

(76) Inventor: Jeffrey J. Berring, 205 22nd St. NW., Canton, OH (US) 44709

( * ) Notice: Subject to any disclaimer, the term of this patent is extended or adjusted under 35 U.S.C. 154(b) by 76 days.

(21) Appl. No.: 10/241,843

(22) Filed: Sep. 13, 2002

(65) Prior Publication Data

US 2004/0049840 A1 Mar. 18, 2004

(51) Int. Cl.[7] ..... A47K 13/00
(52) U.S. Cl. ..... 4/234; 4/241; 4/236; 4/246.5
(58) Field of Search ..... 4/234, 236, 237, 4/240, 241, 248, 246.1, 246.5

(56) References Cited

U.S. PATENT DOCUMENTS 1,251,448 A * 12/1917 Tilden ..... 4/236
1,759,990 A * 5/1930 Leslie ..... 4/236
4,910,810 A * 3/1990 Solomon ..... 4/246.1
4,951,323 A * 8/1990 Shalom ..... 4/246.1

* cited by examiner

*Primary Examiner*—Gregory L. Huson
*Assistant Examiner*—Khoa D. Huynh
(74) *Attorney, Agent, or Firm*—Sand + Sebolt

(57) ABSTRACT

A new sanitary toilet seat apparatus for permitting a user to raise and lower a toilet seat without having to touch the toilet seat directly. The inventive device includes a toilet seat member which is pivotally coupled to a toilet bowl apparatus. At least one counterweight member is coupled to or extends outwardly from the back end of the toilet seat. A lid or cover member of for said toilet seat counterbalances the seat and is provided with a handle for ease of operation well away from the normal contamination areas of the toilet seat.

14 Claims, 4 Drawing Sheets

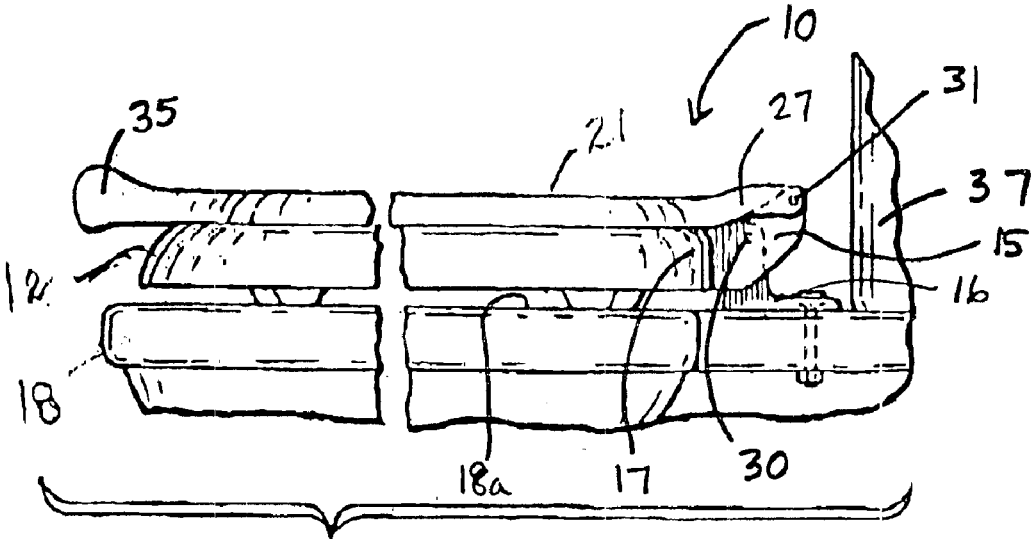
FIG. 2
FIG. 1
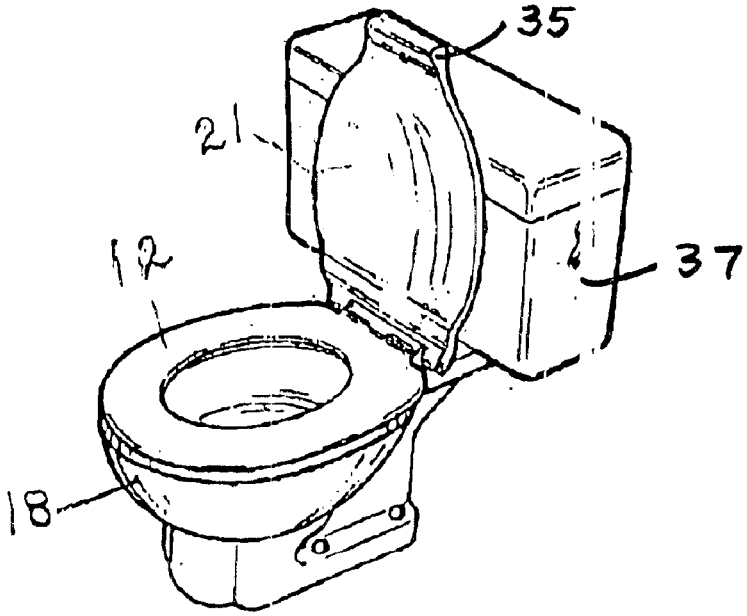

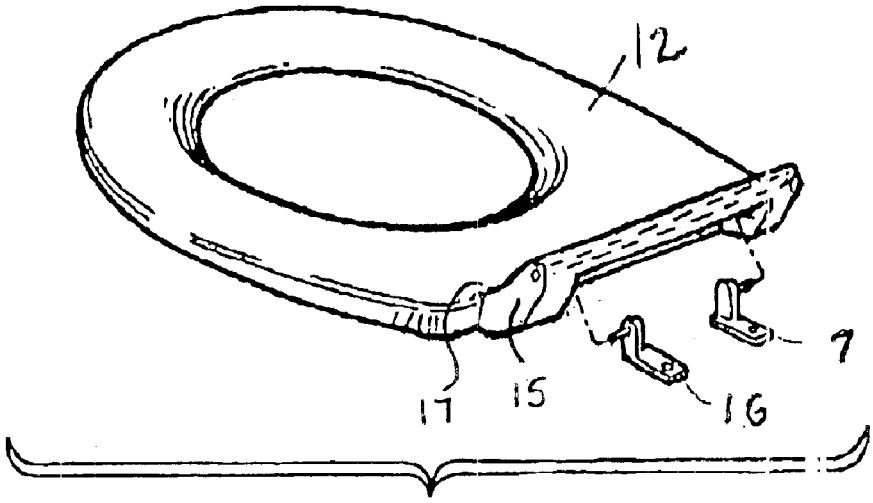
FIG. 4
FIG. 5
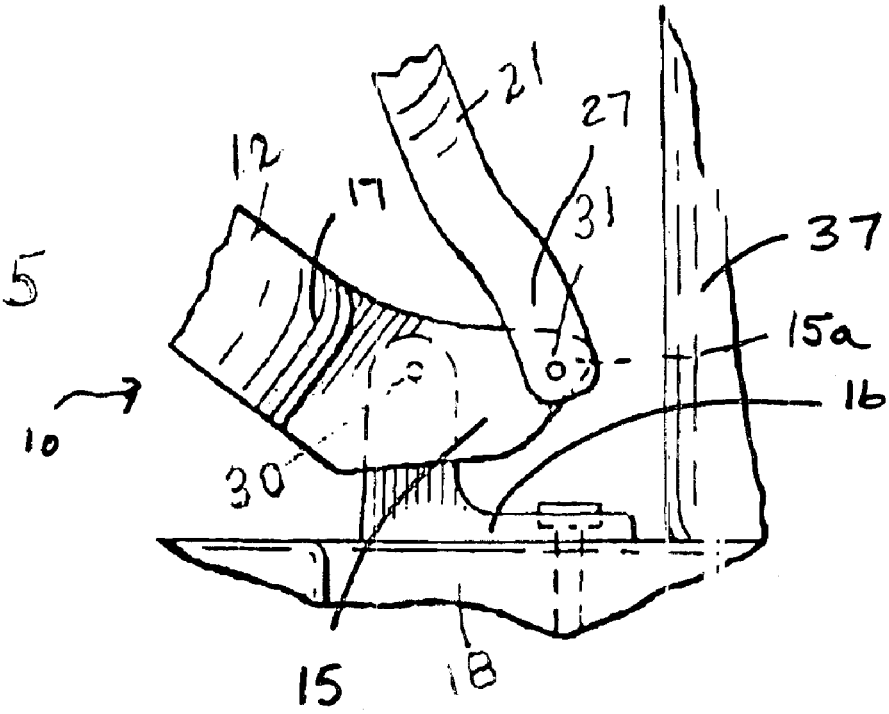

SANITARY TOILET SEAT APPARATUS

BACKGROUND OF THE INVENTION

1. Field of the Invention

The present invention relates to toilet seat lifting devices and more particularly pertains to a new sanitary toilet seat apparatus for permitting a user to raise and lower the toilet seat without having to touch the toilet seat directly.

2. Description of the Prior Art

The use of toilet seat lifting devices is known in the prior art. More specifically, toilet seat lifting devices heretofore devised and utilized are known to consist basically of familiar, expected and obvious structural configurations, notwithstanding the myriad of designs encompassed by the crowded prior art which have been developed for the fulfilment of countless objective and requirements.

Known prior art toilet seat lifting devices include U.S. Pat. No. 5,437,063; U.S. Pat. No. 5,020,165; U.S. Pat. No. 4,910,810; U.S. Pat. No. Des 351,550; U.S. Pat. No. 5,394,570 and U.S. Pat. No. 5,435,017.

While these devices fulfill their respective particular objectives and requirements, the aforementioned patents do not disclose a new sanitary toilet seat apparatus. The inventive device includes a toilet seat which is pivotally coupled to a toilet. At least one counterweight member is coupled to or extends outwardly from the back end of the toilet seat.

In these respects, the sanitary toilet seat apparatus according to the present invention substantially departs from the conventional concepts and designs of the prior art, and in so doing provides an apparatus primarily developed for the purpose of permitting a user to raise and lower a toilet seat without having to touch the toilet seat directly.

SUMMARY OF THE INVENTION

In view of the foregoing disadvantages inherent in the known types of toilet seat lifting devices now present in the prior art, the present invention provides a new sanitary toilet seat apparatus construction wherein the same can be utilized for permitting a user to raise and lower a toilet seat without having to touch the seat directly.

The general purposed of the present invention, which will be described subsequently in greater detail, is to provide a new sanitary toilet seat apparatus and method which has many of the advantages of the toilet seat lifting devices mentioned heretofore and many novel features that result in a new toilet seat apparatus which is not anticipated, rendered obvious, suggested, or even implied by any of the prior art devices, either alone or in any combination thereof.

To attain this, the present invention generally comprises a toilet seat which is pivotally coupled to a toilet bowl for rotation about a first axis. At least one counterweight member extends from the back end of the toilet seat. A lid or cover is pivotally mounted to the counterweight member for rotation about a second axis which lies parallel and adjacent to the first axis of rotation of the counterweight member and provides means for raising or lowering the seat member. The lid or cover member may be used to manually raise or lower the seat member.

There has been outlined rather broadly, the more important features of the invention in order that the detailed description thereof that follows may be better understood, and in order that the present contribution to the art may be appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustration in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception upon which this disclosure is based, may readily be utilized as a basis for designing of other structures, methods and systems for carrying out the several purposed of the present invention. It is important, therefore, that the claims be regarded as including such equivalent constructions insofar as they do not depart from the spirit and scope of the present invention.

Further, the purpose of the foregoing abstract is to enable the U.S. Patent and Trademark office and the public generally, and especially scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new sanitary toilet seat apparatus and method which has many advantages of the toilet seat lifting devices mentioned heretofore and many novel features that result in a new sanitary toilet seat apparatus which is not anticipated, rendered obvious, suggested, or even implied by any of the prior art toilet seat lifting devices, either alone or in any combination thereof.

It is another object of the present invention to provide a new sanitary toilet seat apparatus which may be easily and efficiently manufactured and marketed.

It is a further object of the present invention to provide a new sanitary toilet seat apparatus which is of a durable and reliable construction.

An even further object of the present invention is to provide a new sanitary toilet seat apparatus which may be manufactured at a low cost with regard to both materials and labor, and accordingly may be sold at a lower price to the consuming public, thereby making such sanitary toilet seat apparatus economically available to the buying public.

Still yet another object of the present invention is to provide a new sanitary toilet seat apparatus for permitting a user to raise and lower of toilet seat apparatus without having to touch the toilet seat directly.

Yet another object of the present invention is to provide a new sanitary toilet seat apparatus which includes a toilet seat which is pivotally coupled to a toilet bowl. At least one counterweight member is coupled to the back end of the toilet seat. Also a second counterweighted member such as the lid or cover member is mounted in parallel adjacent relationship to the first counterweight member and thereby in pivotally coupled relation to the toilet bowl. The toilet lid may be raised and lowered separately and independently of the toilet seat.

Still yet another object of the present invention is to provide a new toilet seat apparatus that allows easy raising and lowering of the toilet seat by using only an upper extremity of the lid or cover member to provide leveraging movement of the toilet seat apparatus by contacting only such lid or cover member with little or minimal physical force.

These together with other objects of the invention, along with the various features of novelty which characterize the invention, are pointed out with particularity in the claims annexed to and forming a part of this disclosure. For a better understanding of the invention, its operating advantages and specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective top view of a toilet incorporating the new sanitary toilet seat apparatus according to the present invention;

FIG. 2 is a schematic enlarged first side view of the present invention showing the toilet seat apparatus mounted on the toilet and in the closed position;

FIG. 4 is a fragmentary perspective view of the toilet seat with a pair of fastening elements for connecting the seat to the toilet bowl apparatus;

FIG. 5 is an enlarged fragmentary view of the toilet seat and lid pivotally coupled to the toilet bowl and to each other;

DESCRIPTION OF THE PREFERRED EMBODIMENT

Figure 3:
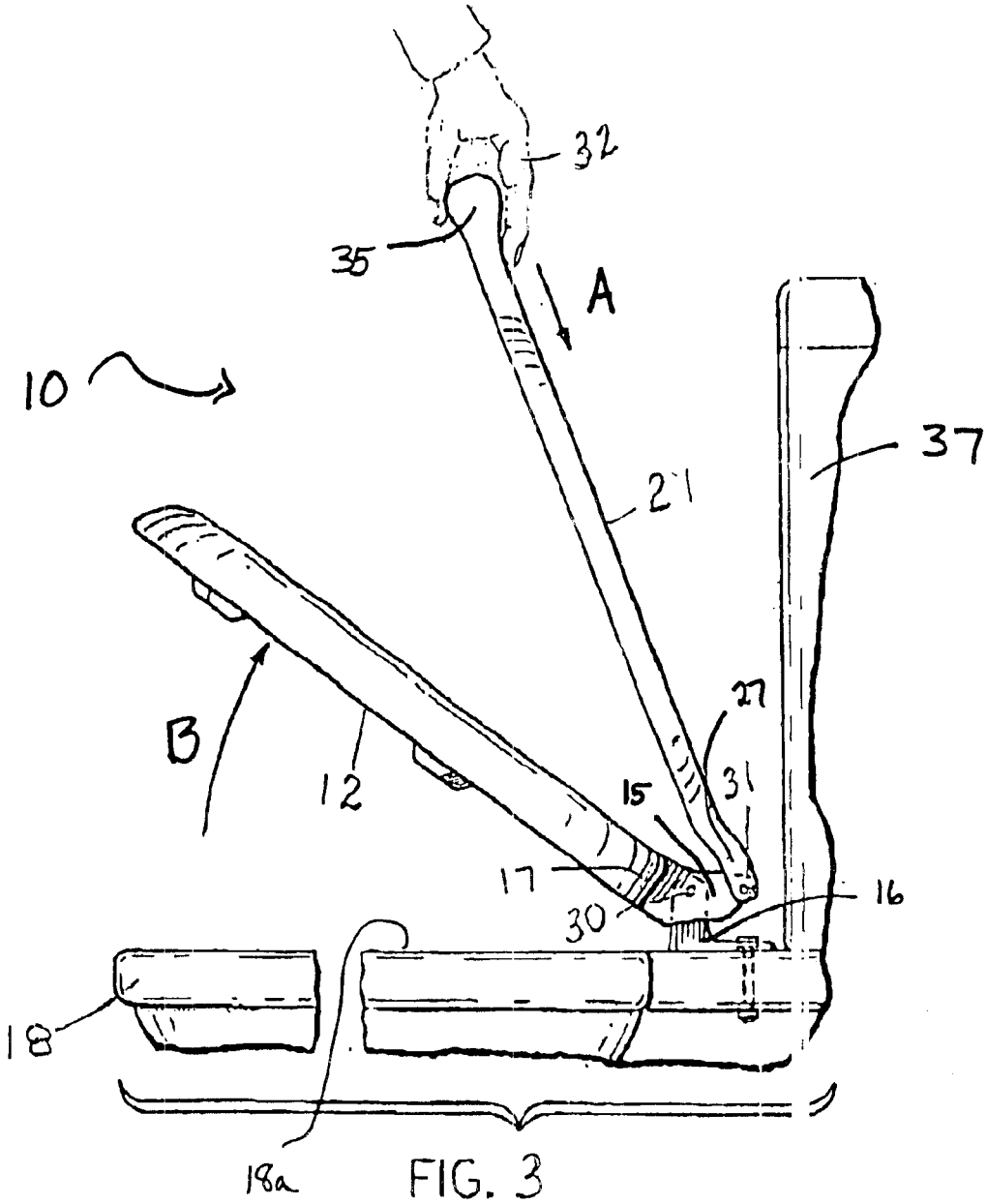
FIG. 3 is a schematic enlarged second side view of the present invention showing the toilet seat and lid member in partially open position.

With reference now to the drawings, and in particular to FIGS. 1 through 6 thereof, a new sanitary toilet seat apparatus embodying the principles and concepts of the present invention and is generally designated by the reference numeral 10 will be described herein.

As best illustrated in FIGS. 1 through 6, the sanitary toilet seat apparatus 10 generally comprises a toilet seat 12 and lid 21 which are pivotally coupled to a toilet bowl 18. A counterbalanced or counterweight member 15 is coupled to and extends outwardly from the back end 17 of the toilet seat 12 (FIG. 5). As shown in FIG. 4, a pair of fastening members 16 and 17 are used to connect the toilet seat 12 to the toilet bowl apparatus 18 which is rigidly and securely fastened in place in a conventional fashion.

The toilet seat 12 is pivotally coupled to the toilet bowl apparatus 18 at a pivot point 30 by the pair of L-shaped fastening members 16 and 17. The counterweight member 15 extends outwardly from the back 17 of seat 12 and beyond pivot point 30. The lid 21 is pivotally coupled to the end 15*a* of the counterweight member 15 at pivot point 31 FIG. 1 shows the lid 21 in its raised position in a perspective view. FIG. 2 shows the toilet seat 12 and the lid or cover member 21 in their closed positions over and covering the toilet bowl apparatus 18.

FIG. 5 shows in an enlarged fragmentary view, the pivot point 30 of the seat 12 and the lid 21 both pivotally coupled to the toilet bowl apparatus 18. The lid 21 is coupled to the balanced seat 12 and the lid 21 may be raised or lowered independently and the seat 12 may be raised or lowered when the lid 21 is in the raised or fully open position.

Figure 6:
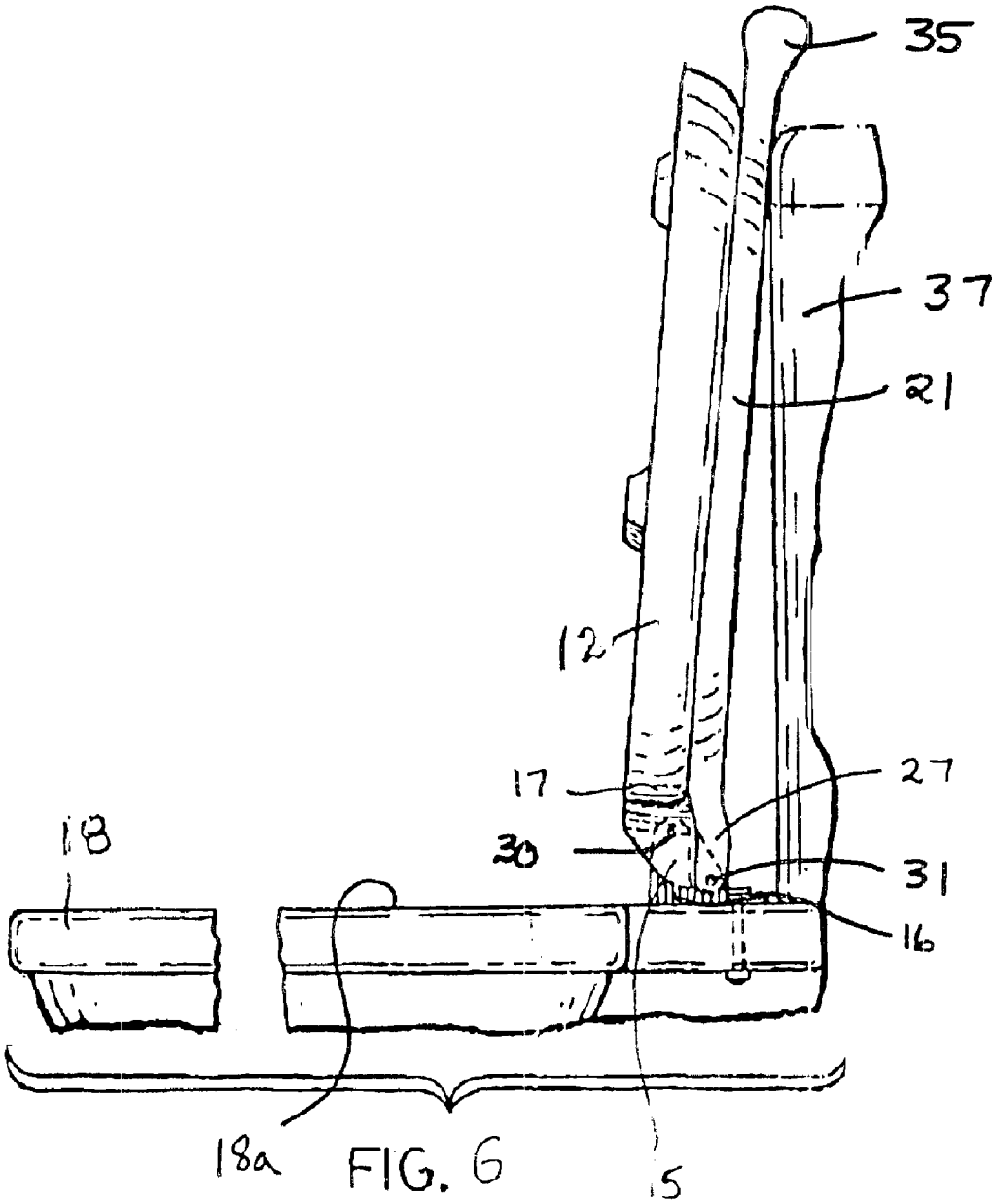
FIG. 6 is a schematic view of the toilet seat apparatus with the toilet seat and lid in a fully opened position.

As shown in FIG. 2, both the seat 12 and lid 21 are closed above the toilet bowl apparatus 18 to essentially reside in a flat plane. FIG. 3 shows the seat 12 and lid 21 in partially raised positions above the toilet bowl apparatus 18. FIG. 6 shows the seat 12 and lid 21 fully raised. When the lid 21 is at least partially raised, the seat 12 may be raised independently by applying minimal downward pressure toward pivot point 31 (as shown by Arrow A in FIG. 3) to the upper end 35 of the lid 21. When it is desired to lower seat 12 independently, the user applies a minimal pulling force in the opposite direction to Arrow A. Such placement of minimal lifting force to the upper end 35 of the lid 21 permits raising and lowering of the seat 12 and lid 21 as desired without the use of excessive lifting force to the seat 12 and lid 21. This action may be easily-actuated by elderly or disabled persons who may have difficulty in lifting the seat 12 and/or lid 21.

The prior art includes U.S. Pat. No. 5,940,896 to the same discloses an elongated vertical handle member which is pivotally coupled to a counterweight member. The upper end of the handle member is operated vertically to raise and lower the toilet seat. The present invention is substantially different in construction and operates differently from the invention disclosed in U.S. Pat. No. 5,940,896.

The present invention utilizes a double hinge construction at the back ends 17, 27 of the seat 12 and lid 21, respectively, to effect movement of the seat 12 and lid 21. The two pivot points 30 and 31 of seat 12 and lid 21 respectively are located in essentially the same plane and adjacent to each other. The sequential movement at the two pivot points 30 and 31 permits the seat 12 and lid 21 to be moved sequentially by slight vertical movement of the lid upper end 35. Contacting only the upper end 35 of the lid 21 and moving same vertically downwardly toward pivot point 31 only a short distance (as shown by Arrow "A" in FIG. 3) allows both the seat 12 and lid 21 to be vertically raised (as shown by Arrow "B"). Only slight vertical movement of the lid 21 such as by a hand designated by the numeral 32 permits seat 12 and lid 21 to be raised. The partial rotation of the pivot point 31 in a clockwise direction about pivot point 30 permits elevation of the seat 12 and lid 21 as desired. It will be seen from FIG. 2, when the seat 12 and lid 21 are in a closed position, pivot point 31 lies vertically further from the upper surface 18*a* of bowl 18 than does pivot point 30. It will be see from FIG. 6, that when seat 12 and lid 21 are in a fully open position, pivot point 31 lies vertically closer to the upper surface 18*a* of bowl 18 than does pivot point 30.

In use, the user utilizes the upper end 35 of the lid 21 to both raise and lower the toilet seat 12 relative to the toilet bowl apparatus 18. When pivoting the toilet seat 12 from the lowered or closed position (FIG. 2) toward the raised position where the lid 21 lies adjacent the tank 37, the user pushes downwardly, in the direction of Arrow "A" and toward pivot point 31 on the upper end 35 of the lid 21. Conversely, when pivoting the toilet seat 12 and lid 21 from their raised or fully open positions to the lowered positions where the toilet seat 12 lies adjacent the upper surface 18*a* of toilet bowl apparatus 18, the user pulls upwardly on the lid upper edge 35 in the opposite direction to Arrow "A".

Seat 12 is preferably manufactured from durable moldable thermoplastic material such as polyethylene, polystyrene or polyurethane material having balanced front and rear portions which surround the pivot point 30. Thus, the seat 12 is easily rotatable about the pivot point 30.

It is to be realized that the optimum dimensional relations for the parts of the invention, to include variations in size, materials, shape, form, function and manner of operation assembly and use, are deemed readily apparent and obvious to those skilled in the art, and all equivalent relationships to those illustrated in the drawings and described in the specification are intended to be encompassed by the present invention.

Therefore, the forgoing is considered as illustrative only of the principles of the invention. Numerous modifications and changes will readily occur to those skilled in the art, and it is not desired to limit the invention to the exact construction and operation shown and described herein.

I claim:

1. A sanitary toilet seat assembly for attachment to a toilet bowl apparatus comprising (a) a toilet seat member having top and bottom surfaces, front and back ends, and a pair of side surfaces, (b) said back end of said toilet seat member being pivotally coupled to said toilet bowl apparatus at a first axis whereby the toilet seat member is rotatable between a closed position where the seat member abuts an upper surface of the toilet bowl apparatus and a fully open position where the seat member is disposed substantially vertical to the upper surface of the toilet bowl apparatus;

(c) a counterweight member integrally formed with the back end of the toilet seat and extending rearwardly therefrom for a distance beyond the first axis; the counterweight member having an end remote from the first axis;

(d) a lid pivotally connected to the end of the counterweight member at a second axis; the second axis being disposed rearwardly of the first axis; whereby the lid is rotatable between a closed position where the lid abuts the top surface of the seat member and a fully open position where the lid lies substantially vertical to the upper surface of the toilet bowl apparatus; and (e) a handle extending outwardly from a front end of the lid and beyond the front end of the toilet seat member; whereby the handle is adapted for raising and lowering the lid and additionally for raising and lowering the seat by selectively applying a force either toward or away from the second axis.

2. The sanitary toilet seat assembly in accordance with claim 1, wherein said toilet seat member is supported horizontally on said toilet bowl apparatus by the upper surface of said bowl apparatus.

3. The sanitary toilet seat assembly in accordance with claim 1, wherein said handle member is adapted to move said toilet seat member and said lid pivotally upwardly separately and independently of said toilet bowl apparatus.

4. The sanitary toilet seat assembly in accordance with claim 1, further comprising a pair of L-shaped connectors for pivotally connecting the toilet seat member to the toilet bowl apparatus.

5. The sanitary toilet seat assembly in accordance with claim 1, wherein the handle member is integrally formed with the front end of the lid.

6. The sanitary toilet seat assembly in accordance with claim 5, wherein the handle member is of a greater cross-sectional height than is the lid.

7. The sanitary toilet seat assembly in accordance with claim 1, wherein when the seat member and lid are in the fully closed position, the second axis is disposed vertically further from the upper surface of the bowl apparatus than is the first axis and the second axis is disposed horizontally further from the back end of the toilet seat member than is the first axis; and when the seat and lid are in the fully open position the first axis is disposed vertically further from the upper surface of the bowl than is the second axis and the second axis is disposed horizontally further from the back end of the toilet seat member than the first axis.

8. A sanitary toilet seat assembly comprising:

a toilet seat adapted to be pivotally connected to a toilet bowl at a first pivot point;

a lid pivotally connected to the toilet seat at a second pivot point;

a lever arm disposed between the first and second pivot points;

whereby applying a first force to the lever arm causes a front end of the toilet seat to pivot away from the toilet bowl; and applying a second force to the lever arm causes the front end of the toilet seat to pivot toward the toilet bowl wherein the second pivot point lies further rearwardly from the front end of the toilet seat than does the first pivot point; and a handle disposed on the front end of the lid, said handle is used to apply said first and second forces to the lever arm.

9. The sanitary toilet seat assembly in accordance with claim 8, wherein the handle comprises an area of increased thickness integrally formed with the front end of the lid.

10. The sanitary toilet seat assembly in accordance with claim 9, wherein the handle extends beyond the front end of the toilet seat when an inner surface of the lid and an outer surface of the toilet seat lie in abutting contact.

11. The sanitary toilet seat assembly in accordance with claim 8, wherein the first force is applied by pushing the front end of the lid inwardly toward the second pivot point.

12. The sanitary toilet seat assembly in accordance with claim 8, wherein the second force is applied by pulling the front end of the lid outwardly away from the second pivot point.

13. A method of using a toilet seat assembly comprising the steps of:

(a) providing a toilet seat assembly having a seat pivotally connected to a toilet bowl at a first axis, a counterweighted member extending from a back end of the seat and having an end remote from the first axis; and a lid pivotally connected to the remote end of the counterweighted member at a second axis; the lid having a handle disposed at a front end thereof, said handle extending outwardly from the front end of the lid and beyond a front end of the seat; wherein the lid and seat are rotatable between a closed position where the lid and seat lie substantially parallel to an upper surface of the toilet bowl; and an open position where the lid and seat lie substantially vertical to the upper surface of the toilet bowl;

(b) raising the lid from a closed position to an open position by grasping the handle and moving the handle and lid in an upwardly and toward a rear end of the toilet bowl in an arc;

(c) raising the seat by pushing the handle downwardly toward the second axis when the lid is in a partially raised position intermediate the closed and open positions.

14. The method of using a toilet seat assembly in accordance with claim 13, further comprising the steps of:

(d) lowering the seat from an open position to a closed position by grasping the handle and pulling the handle upwardly and outwardly away from the second axis;

(e) lowering the lid from an open position to a closed position by continuing to hold the handle and moving the handle downwardly in an arc.

* * * * *